United States Patent [19]

Ohai

[11] 4,351,506

[45] Sep. 28, 1982

[54] LOOP FOR LEVELING A HANGING LAMP

[76] Inventor: Reynolds K. Ohai, 8135 Pinositas Rd., Whittier, Calif. 90605

[21] Appl. No.: 239,354

[22] Filed: Mar. 2, 1981

[51] Int. Cl.[3] ..... F21V 21/00

[52] U.S. Cl. ..... 248/344; 248/342; 248/343; 362/249; 362/250; 362/382; 362/396; 362/399; 362/457

[58] Field of Search ..... 362/399, 396, 400, 382, 362/249, 250, 457; 248/339, 340, 341, 342, 343, 344

[56] References Cited

U.S. PATENT DOCUMENTS

| | | | |
|---|---|---|---|
| 717,012 | 12/1902 | Menzie | 362/400 |
| 913,977 | 3/1909 | Pitel | 362/396 |
| 1,012,582 | 12/1911 | Aspinwall | 248/342 |
| 1,093,367 | 4/1914 | Wakefield | 248/342 |
| 1,180,941 | 4/1916 | Phelps | 362/399 |
| 1,333,764 | 3/1920 | Moltham | 362/399 |
| 1,352,708 | 9/1920 | Whecel | 362/396 |
| 1,487,181 | 3/1924 | Robinson | 248/342 |
| 1,572,728 | 2/1926 | Kestell | 248/344 |
| 1,683,904 | 9/1928 | Knoblock | 248/342 |
| 1,883,620 | 10/1932 | D'Olier, Jr. | 362/396 |
| 3,267,203 | 8/1966 | Rosenberg | 362/249 |
| 3,486,683 | 12/1969 | Kamins et al. | 248/340 |
| 4,128,226 | 12/1978 | Ross et al. | 362/396 |

FOREIGN PATENT DOCUMENTS

| | | | |
|---|---|---|---|
| 211429 | 10/1950 | Austria | 362/396 |
| 435632 | 9/1935 | United Kingdom | 362/399 |
| 624727 | 6/1949 | United Kingdom | 248/343 |

*Primary Examiner*—Teddy S. Gron
*Attorney, Agent, or Firm*—Edgar W. Averill, Jr.

[57] ABSTRACT

A loop for leveling a hanging lamp. The loop has several notches for holding the lowermost link of a swag chain at several possible positions along the interior of the loop. The loop is then affixed to a lamp in a manner which permits turning it to any desired location so that a hanging lamp which would not hang straight if hung from its center may be made to hang straight by placing the lowermost link in a notch other than the center notch and rotating the loop to a position to correct the imbalance.

7 Claims, 5 Drawing Figures

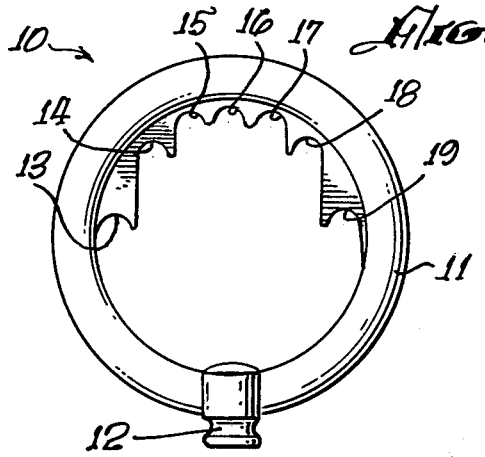
FIG. 1.
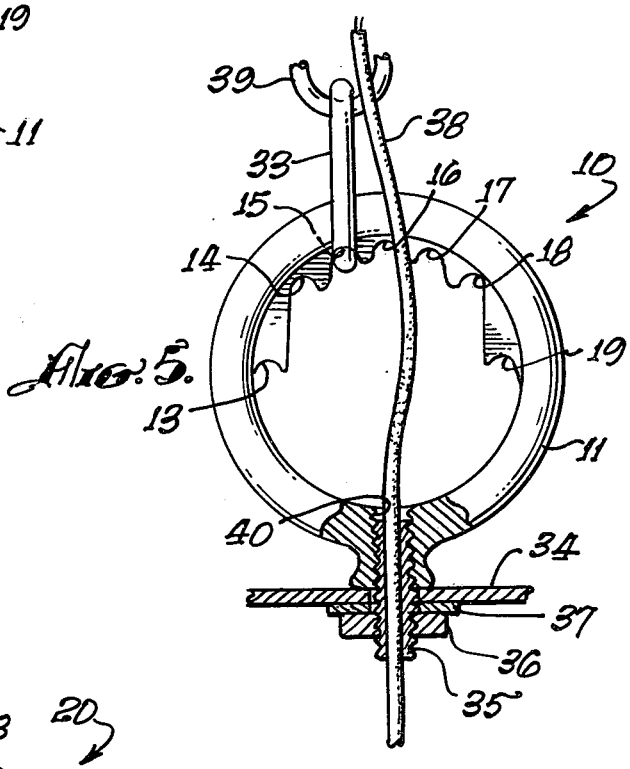
FIG. 5.
FIG. 2.
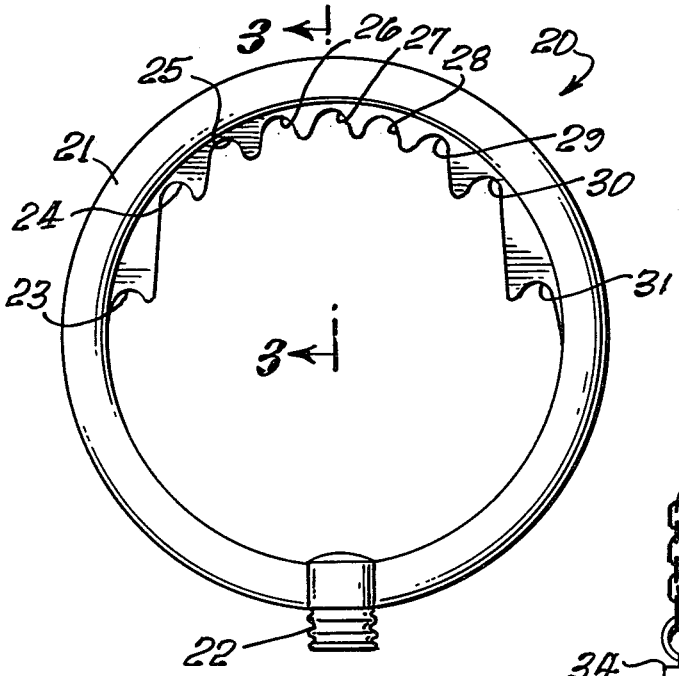
FIG. 3.
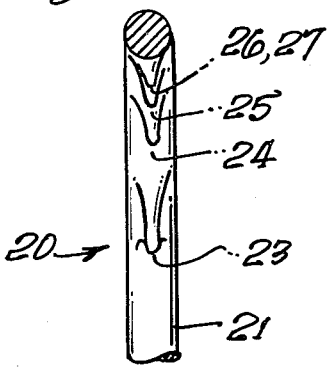
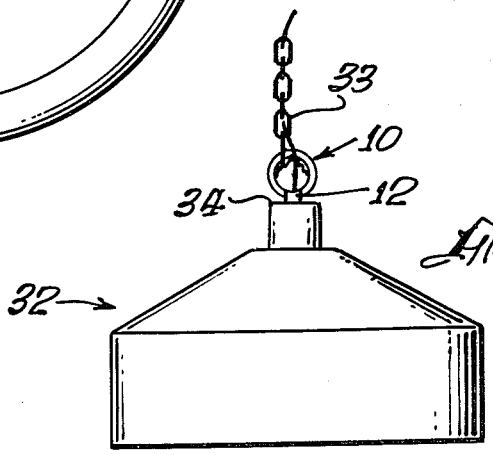
FIG. 4.

LOOP FOR LEVELING A HANGING LAMP

BACKGROUND OF THE DISCLSURE

The field of the invention is hardware for lamps, and the invention relates more specifically to hanging lamps of the type commonly referred to as "swag lamps". Most lamps when manufactured are balanced either by the addition of weights or by the symmetrical manufacture of the lamp. However, once a glass piece of the lamp is broken and a new piece is replaced, the new piece may not be the same weight as the old piece, and the lamp may no longer hang straight. In the past, this has been corrected by either the addition of weights or by the use of a swivel positioned at the top of the lamp to change the position of the top of the loop. Both of the above procedures are cumbersome and relatively expensive, and a simple method is needed to correct for the imbalance of certain hanging lamps.

SUMMARY OF THE INVENTION

It is thus an object of the present invention to provide an inexpensive and simple method for correcting the imbalance of hanging lamps.

The present invention is for a loop for leveling a hanging lamp. The loop has a plurality of link receiving notches and means for affixing the loop to a hanging lamp. The means allows the rotating of the loop with respect to the lamp so that the hanging point of the lamp may be easily and accurately changed so that the lamp will hang in a horizontal or level position.

BRIEF DESCRIPTION OF THE DRAWINGS

FIG. 1 is a side elevation of the loop of the present invention.

FIG. 2 is an alternate configuration of the loop of FIG. 1.

FIG. 3 is a cross-sectional view taken along line 3—3 of FIG. 2.

FIG. 4 is a side elevation of a hanging lamp utilizing the loop of FIG. 1.

FIG. 5 is an enlarged fragmentary view partly in cross section of the loop and lower swag chain loop of the hanging lamp of FIG. 4.

DESCRIPTION OF THE PREFERRED EMBODIMENTS

A loop for leveling a hanging lamp is indicated generally by reference character 10 in FIG. 1. Loop 10 is formed from a ring 11 which is integral with a threaded hollow base 12 which is also shown in cross-sectional view in FIG. 5. Loop 10 has integral thereto a plurality of link receiving notches indicated by reference characters 13 through 19 which are flanged on the upper inside surface of ring 11. Loop 10 may be fabricated by casting from brass or other alloys.

An alternate version of the loop is shown in FIG. 2 where loop 20 is formed from a ring 21 and has a threaded hollow base 22 similar to that described above. Loop 20 has nine link receiving notches indicated by reference characters 23 through 31, each of which is capable of holding the lowermost link of a swag chain in a manner shown best in FIG. 5.

Loop 20 is shown in cross-sectional view in FIG. 3 where it can be seen that the notches are cast integrally on the inner surface of ring 21.

A hanging lamp 32 is shown in FIG. 4. Lamp 32 is suspended from loop 10 and a lowermost link of the swag chain is indicated by reference character 33 (shown best in FIG. 5). Lowermost link 33 is placed in notch 15 of loop 10.

It is important that loop 10 be capable of being rotated with respect to the lamp which is suspended therefrom. This may be readily accomplished with conventional lamp hardware in a manner shown in FIG. 5. The uppermost portion of hanging lamp 32 is indicated by reference character 34 and has a hole formed therein for the passage of a threaded nipple 35. Nipple 35 is screwed into the threaded opening 40 of the base 12. The uppermost portion 34 of lamp 32 is then held to nipple 35 by a nut 36 which is screwed onto nipple 35 and which holds a washer 37 against the uppermost portion 34 of the lamp. By loosening nut 36, loop 10 may be rotated with respect to lamp 32 to any position. The lamp cord 38 passes through the center of nipple 35 in a conventional manner and lowermost link 33 is held to its adjacent link 39 also in a conventional manner.

It is preferred that an odd number of notches be used so that the center notch may be utilized to determine the direction of imbalance. It has been found that seven or nine notches provide a sufficient amount of positions so that normal imbalance may be readily corrected.

In operation, when a lamp is discovered to be unbalanced, for any reason, so that it will not hang straight, loop 10 is substituted for the conventional loop and the lamp cord 38 is inserted through the threaded nipple in a conventional manner. The lowermost link 33 is first inserted in the center notch 16 of loop 10 to determine the direction of the imbalance. Nut 36 is then loosened slightly and loop 19 is rotated so that its center plane is parallel with the direction of the imbalance. Link 33 is then moved progressively in the direction of the downward tilt of the lamp until it is placed in a notch which causes the lamp to be level. Thus, in a simple operation, the imbalance may be readily corrected. In the event of extreme imbalance, a larger loop such as loop 20 may be used in place of loop 10.

Although the loops of the present invention are illustrated as circular rings, it is possible that the loop may be rectangular, oval, triangular or other shape as long as the notches are capable of being placed so that the horizontal position of the lowermost link may be changed with respect to the threaded base of the loop.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A loop for leveling a hanging lamp, said loop comprising:

a closed loop having integral thereto a plurality of link receiving notches flanged along the inner and upper surface thereof; and means integral to the lower surface of the loop for affixing said loop to a hanging lamp, said means allowing the rotating of said loop with respect to said lamp, whereby the hanging point of the lamp may be changed to overcome an imbalance of the lamp.

2. The loop of claim 1 wherein said means comprises a hollow nipple threaded on the outside and nut means screwed onto the outside of said nipple.

3. The loop of claim 1 wherein said loop is formed with a circular ring.

4. The loop of claim 1 wherein said loop has seven link receiving notches.

5. The loop of claim 1 wherein said loop has nine link receiving notches.

6. The loop of claim 4 wherein said loop is formed in a circular ring.

7. The loop of claim 5 wherein said loop is formed in a circular ring.

* * * * *